United States Patent [19]

Berta et al.

[11] Patent Number: 4,590,343

[45] Date of Patent: May 20, 1986

[54] KNIFE BLADE AND CLIP CONTACT ARRANGEMENT

[75] Inventors: Riccardo Berta, Neuenhof; Blaise Perrenoud, La Neuveville, both of Switzerland

[73] Assignee: BBC Brown, Boveri & Company, Limited, Baden, Switzerland

[21] Appl. No.: 596,837

[22] Filed: Apr. 4, 1984

[30] Foreign Application Priority Data

Apr. 28, 1983 [CH] Switzerland ..... 2277/83

[51] Int. Cl.[4] ..... H01H 1/42; H01H 1/54

[52] U.S. Cl. ..... 200/282; 200/162; 200/255; 339/255 P; 335/195

[58] Field of Search ..... 200/282, 286, 290, 48 KB, 200/162, 163, 254–258, 50 AA; 361/336, 341, 342, 353, 354, 356, 361; 339/64 M, 258 R, 258 P, 12, 255 P; 335/16, 195

[56] References Cited

U.S. PATENT DOCUMENTS

| | | | |
|---|---|---|---|
| 2,695,350 | 11/1954 | Schultz | 200/48 R |
| 2,732,468 | 1/1956 | Curtis et al. | 200/255 X |
| 3,201,556 | 8/1965 | Baird | 200/282 X |
| 3,887,888 | 6/1975 | Bayles et al. | 335/195 |
| 4,087,668 | 5/1978 | Nakanishi et al. | 200/254 |
| 4,379,956 | 4/1983 | Cleaveland et al. | 200/48 A |
| 4,445,732 | 5/1984 | Wafer | 339/12 R |

FOREIGN PATENT DOCUMENTS

| | | | |
|---|---|---|---|
| 960988 | 9/1982 | U.S.S.R. | 200/254 |

*Primary Examiner*—Stephen Marcus
*Assistant Examiner*—Ernest G. Cusick
*Attorney, Agent, or Firm*—Burns, Doane, Swecker & Mathis

[57] ABSTRACT

A contact arrangement for an isolating switch used as a ground connection of a switch system includes two switch pieces which are movable relative to one another, one of which is a knife and the other is a gripper. The gripper includes two contact pieces which are located opposite and parallel to one another and which engage the knife in the cutting-in state. Each contact piece is in turn formed by a plurality of adjacent contact elements. Such a contact arrangement is simple and economical to produce, while providing reliable contact-making for both high and low currents in spite of only slight static contact pressure. This result is achieved because the contact elements are U-shaped contact lamellae. Each lamella includes first and second legs connected via a curved part, the first leg being supported on the knife in the cutting-in state and the second leg being supported on current terminals formed on the contact pieces.

7 Claims, 4 Drawing Figures

KNIFE BLADE AND CLIP CONTACT ARRANGEMENT

BACKGROUND OF THE INVENTION

The present invention relates to electrical contact arrangements including two switch pieces which are movable relative to one another. A contact arrangement of this type is known for example, from German Offenlegungsschrift No. 1,665,986. This contact arrangement is preferably provided for the contacting of devices extendable from a switch system and has a gripper contact having contact elements which are arranged in pairs opposite one another, which are movable independently of one another and which can be engaged in succession with a knife contact piece. In this arrangement, although the force needed for introducing the knife contact piece into the gripper contact piece is small, nevertheless this arrangement is comparatively expensive, if only because each contact element must be supported by a separate contact spring.

SUMMARY OF THE INVENTION

The object of the present invention is to provide a contact arrangement of the type noted above which can be produced in a simple and economical way, while providing reliable contact-making for both high and low currents.

This object is achieved, according to the present invention, by means of such features as U-shaped contact lamellae having first and second legs supported, respectively, on the knife in the cut-in state and on current terminals formed on the contact pieces. The contact arrangement according to the present invention is further characterised in that there is no need for separate contact springs for the part contact pieces, since the suitably arranged U-shaped contact lamellae provide reliable contact-making when both high and low currents occur. Additional parts, such as particular guides for the knife can be omitted in view of the structure of contact lamellae according to the present invention and because it thereby becomes possible to shape the ends of the legs of the contact lamellae in a suitable way, for example by bending. Furthermore, such a contact arrangement is simple to assemble and maintain because of the coordination of the dimensions and arrangement of components.

BRIEF DESCRIPTION OF THE DRAWINGS

An exemplary embodiment of the subject of the invention is illustrated below in simplified form in the drawings in which.

DESCRIPTION OF THE PREFERRED EMBODIMENT

Figure 1:
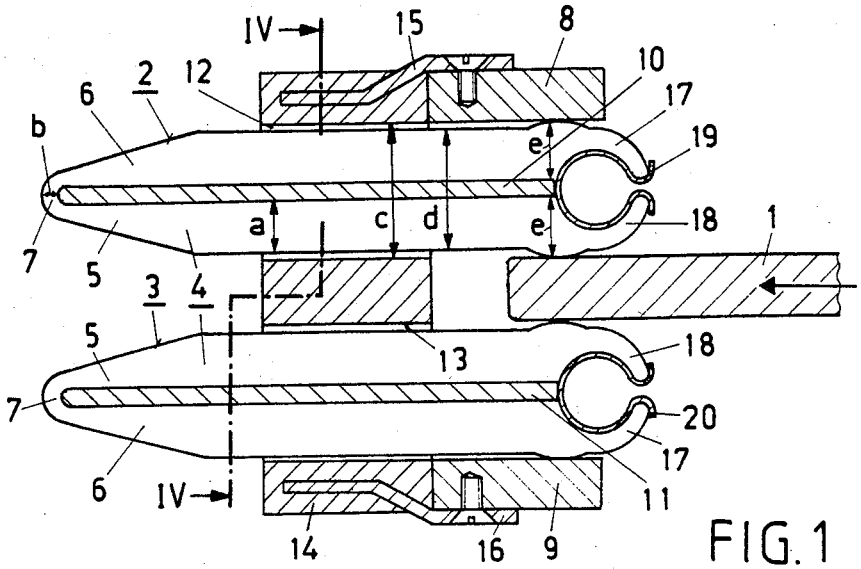
FIG. 1 is a side elevational sectional view through a contact arrangement according to the present invention, taken in the direction of movement of the knife switch piece and at the same time perpendicularly to its contact surfaces, said section being taken along the lines I—I of FIGS. 2 and 4.

In all the Figures, the same parts bear the same reference symbols. The contact arrangement of the present invention illustrated in FIG. 1 in the cutting-in or switch-on state, is intended for an isolating switch, designed as a ground connection, of an encased switch system filled with insulating gas, and includes a movable switch piece, knife 1, which engages two contact pieces 2 and 3, arranged parallel to one another, which make up a fixed switch piece or gripper. The knife 1 is fastened to a rotatably mounted contact support (not shown) extending downwards and, which, for cutting-out purposes can be rotated 90° about an axis perpendicular to the drawing plane and which is offset downwardly by a multiple of the knife length. The contact pieces 2, 3 include contact lamellae 4 arranged adjacent to and supporting one another. The contact lamellae 4 are stamped from a conductive metal sheet and are U-shaped. Each contact lamella 4 includes first and second legs 5, 6, respectively, and a curved connection part 7 connecting the two first legs 5, 6. The legs resting against or being supported on the knife 1 in the cutting-in state, are designated by the reference symbol 5, while the second legs, in contact with or being supported on current terminals 8, 9 of the contact pieces 2, 3 are denoted by the reference symbol 6. The contact lamellae 4 are mounted on plates 10 and 11, which are formed of insulating material, such as, for example, glasss fiber-reinforced plastic, and are pushed into square orifices 12 and 13 of a mounting member 14 which is also formed of insulating material, such as, for example, glass fiber-reinforced plastic. Two straps 15 and 16 are screwed to the terminals 8 and 9 and are attached with an insulating effect to the top side and underside of the mounting member 14.

The connection parts 7 of the contact lamellae 4 have small widths b in comparison with the widths a of the legs 5 and 6. Because of this and because the clearance width c of the square orifices 12 and 13 is made somewhat greater than the width d of the contact lamellae 4, the legs 5 and 6 can move resiliently under the influence of an external force.

The contact lamellae 4 each have bent portions 17 and 18 located at their ends facing away from the connection part 7. The bent portions 17 and 18 extend in opposite directions and together define, in each contact piece 2 and 3, a cavity into which is snapped an open shaped ring 19, 20, which can be bent annularly and which is insulated electrically, for example, by a layer of lacquer. By means of these shaped springs 19, 20 the contact lamellae 4 are maintained in place; the legs 5 and 6 are at the same time subjected thereby to an additional contact force acting, respectively, in the direction of the knife 1, and the terminals 8 and 9. The spring forces of the respective shaped springs 19 and 20 are selected so that the inherent spring forces of the contact lamellae 4 associated with each shaped spring 19, 20 are, by comparison, virtually negligible. As a result, variations in the tolerance of the individual contact lamellae 4, which arise during the stamping of the latter, are eliminated after they have been assembled into the gripper, and good contact is achieved as early as the stage of currentless or static contacting of the respective switch pieces.

As shown in FIG. 1, the bent portions 18 of the legs 5 of the two contact pieces 2 and 3 bend away from the knife 1 in the direction of the leg end, as a result of which it becomes possible to introduce the knife 1 into the fixed switch piece without the use of additional guides. The bent portions 17, 18 have a thickness e. Thus, the distance between the terminals 8, 9 is only a little greater than the sum of four times the thickness e plus the thickness of the knife 1 plus the thickness of the two plates 10, 11. Despite variations in tolerance which are caused for production reasons, the contact lamellae 4 are matched sufficiently to this relatively short distance in view of the abovementioned selection of the thickness of the connection portions 7 and the respective spring forces of the shaped springs 19, 20.

Figure 2:
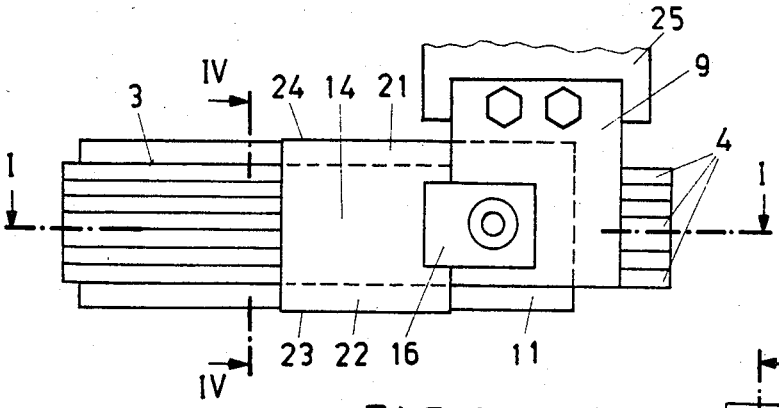
FIG. 2 is a bottom plan view of the gripper switch piece of the contact arrangement according to the present invention.
Figure 3:
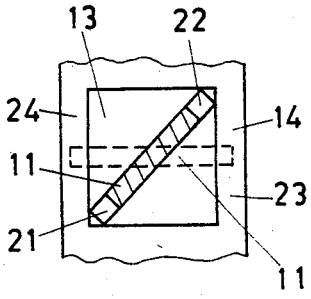
FIG. 3 is a front elevational detail view of part of the contact arrangement according to the present invention shown during its assembly.
Figure 4:
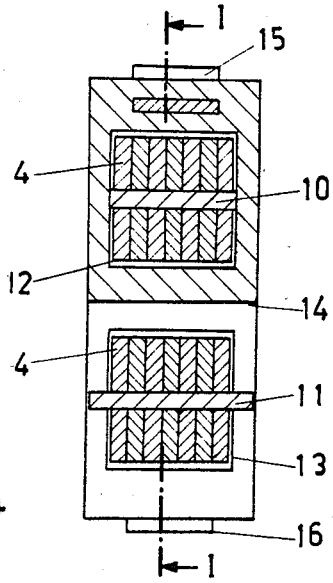
FIG. 4 is a front elevational sectional view of the contact arrangement of the present invention taken along lines IV—IV of FIGS. 1 and 2.

The view, shown in FIG. 2, of the underside of the fixed switch piece or gripper shows a current supply 25 to which the terminals 8 and 9 are screwed and which thus carries the gripper. In FIG. 2, reference symbols 21 and 22 denote two recesses formed in the plate 11 which are filled (as marked by broken lines) by side or portions 23 and 24 of the mounting member 14. These recesses 21 and 22 are intended for fixedly mounting the plates 10 and 11 in the mounting member, 14, in such a way that they maintain the contact lamellae 4 in place when the knife 1 is actuated. As shown in FIG. 3, this fixing is effected when the plate 11 is first arranged diagonally relative to the edges of the square orifice 13, and then is pushed into the mounting member 14 until the recesses 21 and 22 have become aligned with the side parts 23 and 24 of the mounting member 14. Then the plate 11 is rotated in such a way that the mounting member side parts 23 and 24 engage the recesses 22 and 21 (the position shown by broken lines in FIG. 3). After this, the contact lamellae 4 are pushed on to the plates 10 and 11 and secured by snapping in the shaped springs 19 and 20. As a result, the fixed switch piece of the contact arrangement of the present invention will then have the appearance illustrated in FIGS. 1, 2 and 4.

The mode of operation of the contact arrangement according to the present invention is as follows:

During the cutting-in operation, the knife 1 is introduced, in the direction of the arrow indicated in FIG. 1, into the orifice located between the two bent portions 18 of the contact lamellae 4 of the two contact pieces 2 and 3. As soon as the knife 1 engages the bent portions 18, two partial currents flow from the knife 1 to the terminals 8 and 9 via the bent portions 18, the legs 5, the connection parts 7, the legs 6 and the bent portions 17. These partial currents travel in the same direction in the parallel legs 5 of the two contact pieces 2 and 3; whereas in the legs 6 of the two contact pieces 2 and 3 arranged parallel to the legs 5, the partial currents travel in the opposite direction to that of the currents flowing in the legs 5. The respective legs 5 of the two contact pieces 2 and 3 are attracted to one another as a result. Since these legs 5 are at the same time repelled by the legs 6 of each contact lamella 4, through which current flows in the opposite direction, they exert a considerable contact force on the knife 1. Because the legs 5 and 6 of each contact lamella 4, through which current flows in the opposite direction, are repelled, sufficient contact pressure is obtained at the same time between the contact lamellae 4 and the terminals 8 and 9. Since the distance between the legs 5 and 6 of each contact lamella 4 is determined solely by the thickness of the plate 10 or 11, the repulsive forces acting on the legs 5 and 6 and proportional to the square of the current are considerable even when the currents are relatively low.

We claim:

1. A contact arrangement, comprising a mounting member and two switch pieces movable relative to one another, one being a knife and the other being a gripper;

the gripper having two contact pieces which are located in said mounting member opposite one another, each of the contact pieces engaging the knife in a switch-on state;

each contact piece including a plurality of contact lamellae;

each contact lamella including first and second legs each having proximal and distal ends and connected to each other by a curved connection part at the distal ends of the legs to form a U-shaped contact lamellae;

a current terminal being mounted on said mounting member adjacent the proximal end of each of said second legs;

the proximal end of each of said first legs engaging the knife in the switch-on state; and the second contact lamella legs engaging the current terminals in the switch-on state; and wherein a plate is provided for supporting the contact lamellae that is interposed between and in contact with the first and second legs;

each leg further having a respective bent portion formed at its proximal end;

the respective bent portions of said first and second legs of each respective contact piece together defining a cavity; and a shaped spring received in the cavity formed by the legs.

2. A contact arrangement as claimed in claim 1, wherein the bent portion of each of the first legs is bent away from the knife in the switch-on state.

3. A contact arrangement as claimed in claim 1, wherein the curved connection parts of the contact lamellae have a predetermined width; and the width of the curved connection part being sufficiently narrow so as to provide the contact lamellae of a respective contact piece with a spring force which is less than the spring force of the shaped spring.

4. A contact arrangement comprising two switch pieces movable relative to one another, one being a knife, the other being a gripper; and a terminal electrically connected to said gripper;

said gripper having two contact pieces which are located opposite one another in a mounting member, each of said contact pieces having:

a plurality of U-shaped contact lamellae, each having first and second legs connected to each other by a curved connection part with a predetermined width and each having at their open ends oppositely bent portions defining a cavity, a plate for supporting the contact lamellae, said plate having two sides one being engaged for supporting the first legs of said lamellae and the other being engaged for supporting said second legs of said lamellae, and a shaped spring received in the cavity, the width of said curved connection parts of said contact lamellae of each said two contact pieces is such that said contact lamellae has a spring force which is less than the spring force of said shaped spring;

said first legs of said contact lamellae of said two contact pieces engage said knife in the switch-on state and said second legs of said contact lamellae of said two contact pieces engage said terminal.

5. A contact arrangement as claimed in claim 4, wherein said mounting member includes two orifices; the orifices having a cross-sectional dimension sufficiently large to accommodate the contact lamellae.

6. A contact arrangement as claimed in claim 5, wherein each plate is fixedly mounted in one of the two orifices of said mounting member.

7. A contact arrangement as claimed in claim 4, wherein the bent portions of said first legs are bent away from the knife in the switch-on state.

* * * * *